US005377507A

United States Patent [19]

Shima

[11] Patent Number: 5,377,507

[45] Date of Patent: Jan. 3, 1995

[54] METHOD FOR MAKING JOINED FABRIC

[75] Inventor: Masahiro Shima, Wakayama, Japan

[73] Assignee: Shima Keiko Mfg. Ltd., Wakayama, Japan

[21] Appl. No.: 77,945

[22] Filed: Jun. 18, 1993

Related U.S. Application Data

[63] Continuation of Ser. No. 716,906, Jun. 18, 1991, abandoned.

[30] Foreign Application Priority Data

Jun. 21, 1990 [JP] Japan ..... 2-163479

[51] Int. Cl.[6] ..... D04B 7/00

[52] U.S. Cl. ..... 66/69; 66/172 R; 66/175

[58] Field of Search ..... 66/171, 172 R, 175, 66/176, 177, 189, 198, 184, 185, 186, 187, 69, 66, 67, 70, 76, 169 R, 178 R

[56] References Cited

U.S. PATENT DOCUMENTS 2,319,768 5/1943 Beers ..... 66/187
2,319,771 5/1943 Beers ..... 66/187
2,322,802 6/1943 Lambach ..... 66/187

FOREIGN PATENT DOCUMENTS 826350 9/1937 France ..... 66/187

OTHER PUBLICATIONS

"Reducing sewing" *Knitting International,* Apr. 1976, vol. 83 No. 988 p. 89.

*Primary Examiner*—Clifford D. Crowder
*Assistant Examiner*—Larry D. Worrell, Jr.
*Attorney, Agent, or Firm*—Spensley Horn Jubas & Lubitz

[57] ABSTRACT

A method for producing a flat knitted fabric, which may include first and second fabrics joined together with their respective wale directions perpendicular to one another, using a flat knitting machine. In accordance with one embodiment of the method, endmost loops of the first fabric knitted in one section of a bed may be transferred to needles which have been used to knit the endmost loops of in a course of a second fabric knitted by needles in another section in order to overlap the loops. A succeeding course of the second fabric may be passed through the overlapped loops to join the fabric.

7 Claims, 7 Drawing Sheets

Z
X
V
T
S
U
W
Y
Q
O
M
K
I
A
C
E
G
H
F
D
B
J
K
L
M
O
1
2
3
4
5
6
7
8

A B C D E F G H I J K L M N O P Q R S T U V W X Y Z
B
F
FRONT BODY FRONT STITCH KNIT
FRONT BODY MISS (REST)
BACK BODY FRONT STITCH KNIT
BACK BODY MISS (REST)
FRONT BODY RAVELING CORD MISS (REST)
FRONT-FRONT BODY STITCH OVERLAP
TRANSFERRING FROM F TO B
BACK-BACK BODY STITCH OVERLAP
TRANSFERRING FROM B TO F
BACK BODY RAVELING CORD MISS (REST)

METHOD FOR MAKING JOINED FABRIC

This is a continuation of application Ser. No. 716,906 filed on Jun. 18, 1991, now abandoned.

FIELD OF THE INVENTION

The present invention relates to a method for making a flat knitted fabric, which may include first and second fabrics joined together with such that their respective wale directions are perpendicularly crossed, using a flat knitting machine.

RELATED ART STATEMENT

In the manufacture of products using knitted fabrics, it is common to select fabrics different in weave, yarn, etc. and to use them in various parts of the products. In a sweater, for example, while one fabric used for the body and sleeve, a relatively elastic fabric may be used for the wrist band portion and a relatively strong fabric may used for the arm hole portion. Heretofore, these fabric portions have been separately produced by knitting and combined together by methods such as sewing and linking.

When these fabric portions are continuous to each other, for example when a sleeve is first formed by plain stitch knitting and, subsequently, a wristband is formed by rib stitch knitting, the knitting operations can be done in a continuous manner using the same knitting machine. This cannot be done, however, in the case where fabrics to be joined together are different in the direction of wale. Heretofore, when knitting the wristband of a vest, or the gore of a crotch portion of tights or pants, it has been necessary to attach the wristband or gore prepared separately to the main fabric portion and sew it in the perpendicular course directions after knitting in order for the loops of the wristband or gore and the loops of the main fabric portion to be joined together in perpendicular course directions. This results in an increase in the number of production steps and a corresponding increase in manufacturing costs. Additionally, as the gore of the crotch portion is attached as described above, the joined portion in inevitably poor in extensibility. This results in a product which is not comfortable and whose seams are sometimes unraveled when the wearer exercises.

OBJECT AND SUMMARY OF THE INVENTION

It is an object of the invention to provide a method which permits knitting of two kinds of fabrics which are different in wale direction in a continuous state.

According one embodiment of the present invention, a first fabric formed by knitting with needles arranged in a predetermined section of a needle bed may be rendered inoperative, at every knitting of one course of a second fabric formed by knitting with needles arranged in another section of the needle bed, endmost loops of the course closest to the fabric rendered inoperative and endmost loops of the fabric reordered inoperative are overlapped by racking successively at every knitting of a predetermined number of courses in the second fabric. Thereafter, the next course knitting loops are passed through the overlapped loops to join the first and second fabrics together.

According to one embodiment of the present invention, a first fabric is formed beforehand by knitting with needles arranged in a predetermined section of a needle bed, endmost loops of the first fabric are transferred to needles which have been used for knitting endmost loops in a course of a second fabric formed by knitting with needles arranged in another section adjacent to the predetermined section, and course knitting loops in the second fabric are passed through the overlapped loops to combine both fabrics. By performing this operation at every knitting of a predetermined number of courses in the second fabric, it is possible to obtain a joined fabric consisting of first and second fabrics which are different than each other in wale direction.

BRIEF DESCRIPTION OF THE DRAWINGS

FIGS. 5–1 to 5–17 are step by step knitting diagrams showing fabrics loops engaged with needles on front and back needle beds, as well as a yarn feeding states in accordance with one embodiment of the present invention.

DETAILED DESCRIPTION OF THE PREFERRED EMBODIMENT

In accordance with one embodiment of the present invention, two fabrics which are different in wale direction can be knitted integrally while crossed in wale direction a flat knitting machine. For example, a method in accordance with the present invention can be utilized in knitting clothing edge portions such as those illustrated in FIGS. 1 and 2.

Figure 2:
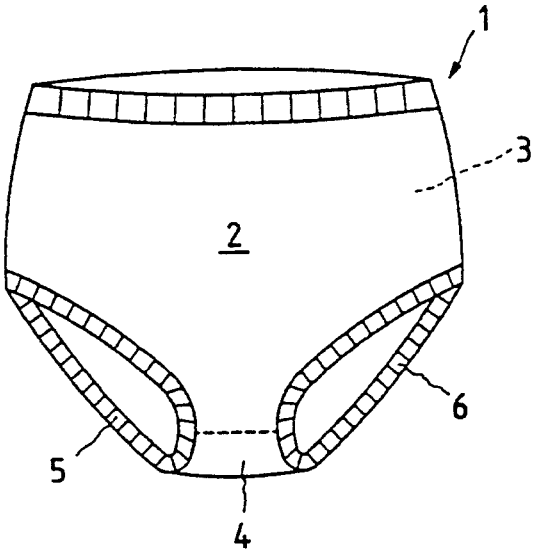
Figure 6A:
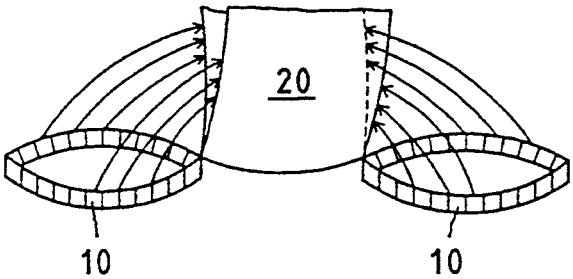
FIG. 6A is a perspective view showing the state at which bottom bands of the shorts shown in FIG. 1 are attached by knitting to a gore portion in accordance with one embodiment of the present invention.

FIG. 6A illustrates the bottom bands and gore of the shorts illustrated in FIG. 2. In accordance with the present invention, first fabrics 10 which constitute annular bottom bands and a second fabric 20 which constitutes a gore under the crotch can be integrally formed during knitting of the gore.

Figure 6B:
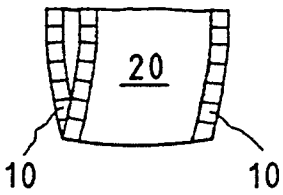
FIG. 6B is a perspective view showing the bottom bands and the gore portion which have been made integral with each other in accordance with one embodiment of the present invention.

Since the first and second fabrics 10, 20 are formed using two or four beds of a flat knitting machine, wales of both fabrics are vertically arranged. As indicated by arrows in FIG. 6A, when the first fabrics 10 are overlapped with course ends of the second fabric 20, knitting is performed successively from set-up course to next course in the second fabric 20, thereby knitting the first and second fabrics in a crossed state in wale direction, as illustrated for example in FIG. 6B.

One embodiment of the present invention will be described below. Additionally, although flat knitting machines having either two or four needle beds may be used for practicing the method of the present invention, the following description will relate to an example of a method using a flat knitting machine having two needle beds.

Figure 1:
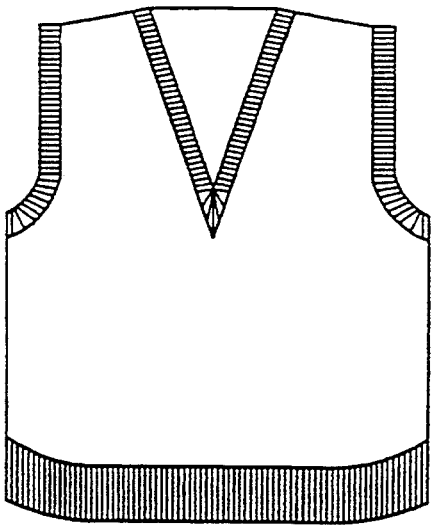
FIGS. 1 and 2 are front views of a vest and a pair of shorts which may be formed by knitting in accordance with one embodiment of the present invention.

Examples of a joined fabric obtained by joining two kinds of fabrics in accordance with an embodiment of the present invention include the sweater arm hole shown in FIG. 1 and the bottom band portion of the shorts shown in FIG. 2. As an example, the knitting of the shorts bottom band portion will be described below.

As shown in FIG. 2, shorts 1 include front fabric 2 and back fabric 3 which are connected to each other by a gore 4. The shorts 1 also include left bottom rib stitch portion 5 and right bottom rib stitch portion 6 formed along the peripheral edges of leg holes.

Figure 3:
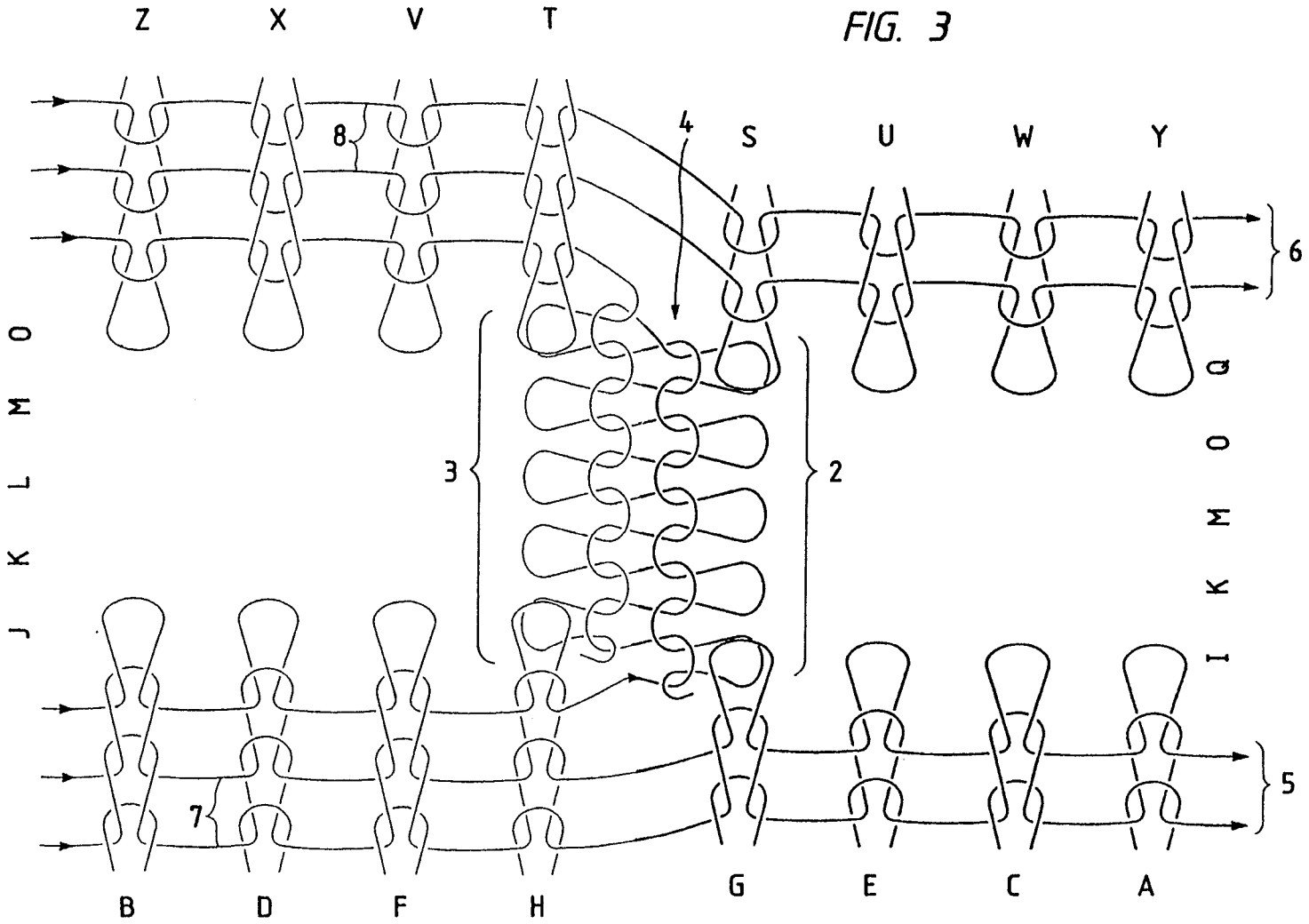
FIG. 3 is a design diagram of loops as seen from the inside of a first fabric and a second fabric which have been subjected to course knitting to a slight extent in accordance with one embodiment of the present invention.
Figure 4:
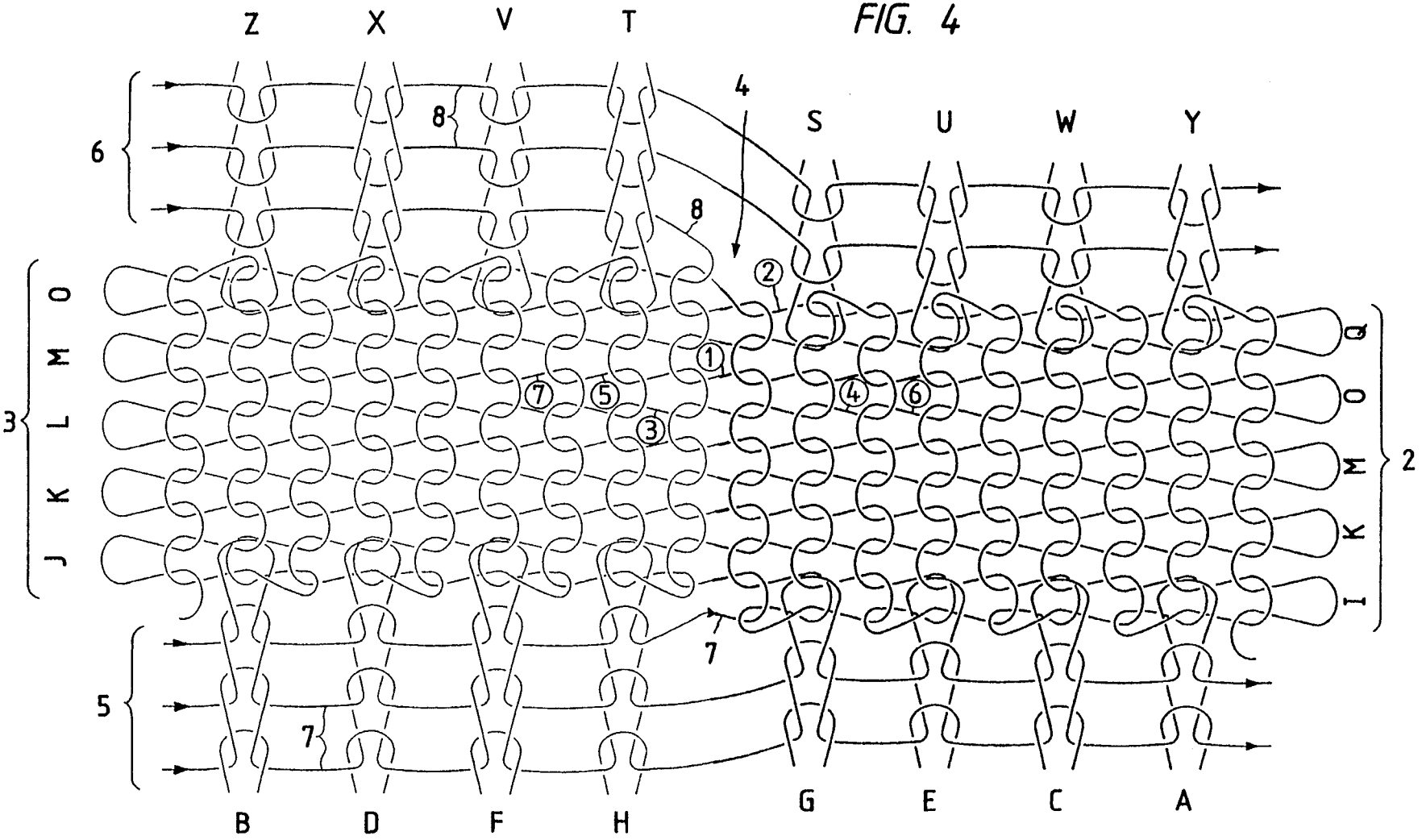
FIG. 4 is a design diagram showing an advanced state of the knitting of the first and second fabrics in accordance with one embodiment of the present invention.

In one embodiment of a method in accordance with the present invention, the left and right bottom bands are first knitted, then in knitting gore 4, loops of the bottom rib stitch portions 5, 6 already formed are knitted into the gore 4 to obtain an integral part. FIGS. 3 and 4 show related designs. Yarn 7, which has been used for knitting the left bottom rib stitch portion 5, may be used for knitting the front fabric 2 (including the gore 4). Yarn 8, which has been used for knitting the right bottom rib stitch portion 6, may be used for knitting back fabric 3 (including the gore 4).

Figures 1, 2, 3, 4, 5:
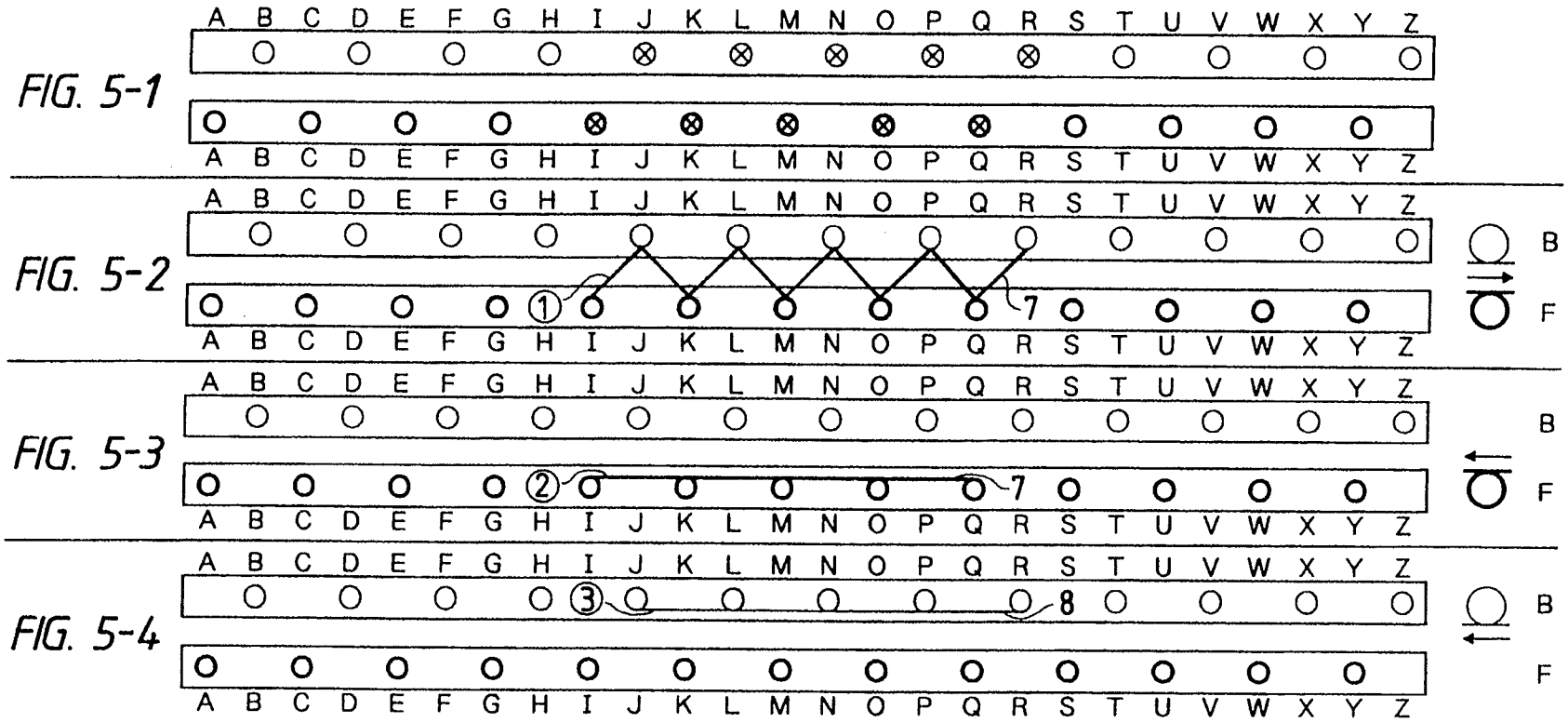

The knitting process will now be explained with reference to FIG. 5. In this example, each part is knitted using a smaller number of needles than that which would actually be used.

In knitting the shorts 1, the left and right bottom rib stitch portions 5, 6 are knitted beforehand as the first fabrics 10. The left bottom rib stitch portion 5 is circularly knitted in the clockwise direction by needles B, D, . . ., H on a back bed B side and needles G, E, . . ., A on a front bed F side. The right bottom rib stitch portion 6 in circularly knitted in the counterclockwise direction by needles Z, X, . . ., T on the back bed B side and needles S, U, . . ., Y on the front bed F side. This causes the knitting of predetermined courses in a cylindrical form. In this example, a knitting end position is assumed to be the needle position closest to the gore 4 in each of both bottom rib stitch portions. FIG. 5–1 shows an arrangement of fabric loops engaged with needles on the front and rear beds in a completed state of knitting for both of the bottom rib stitch portions 5 and 6.

Next, the gore 4 is knitted. Yarn is fed to every other needle I, K, . . ., Q, on the front bed F side and also to every other needles J, L, . . ., R on the back bed B side, to knit a set-up course "1" in the gore 4 (FIG. 5–2). The yarn 7 which has been used for knitting the left bottom rib stitch portion is used to knit the gore of the back fabric 3. A course "2" in the front fabric 2 is knitted on the front bed F side (FIG. 5–3) with a plain stitch using the same yarn 7 and needles Q, O, . . ., I. For knitting a course "3" in the back fabric 3, the yarn 8 which has been used for knitting the right bottom rib stitch portion 6 is fed to knit the gore of the back fabric 3 with a plain stitch using needles R, P, . . ., J on the back bed B side (FIG. 5–4). Thus, three fabrics are knitted by the operations described above. These fabrics include the left and right bottom rib stitch portions 5, 6 and the courses "2", "3" which follow the set-up course "1" of the gore 4.

Figures 5, 6, 7, 8, 9:
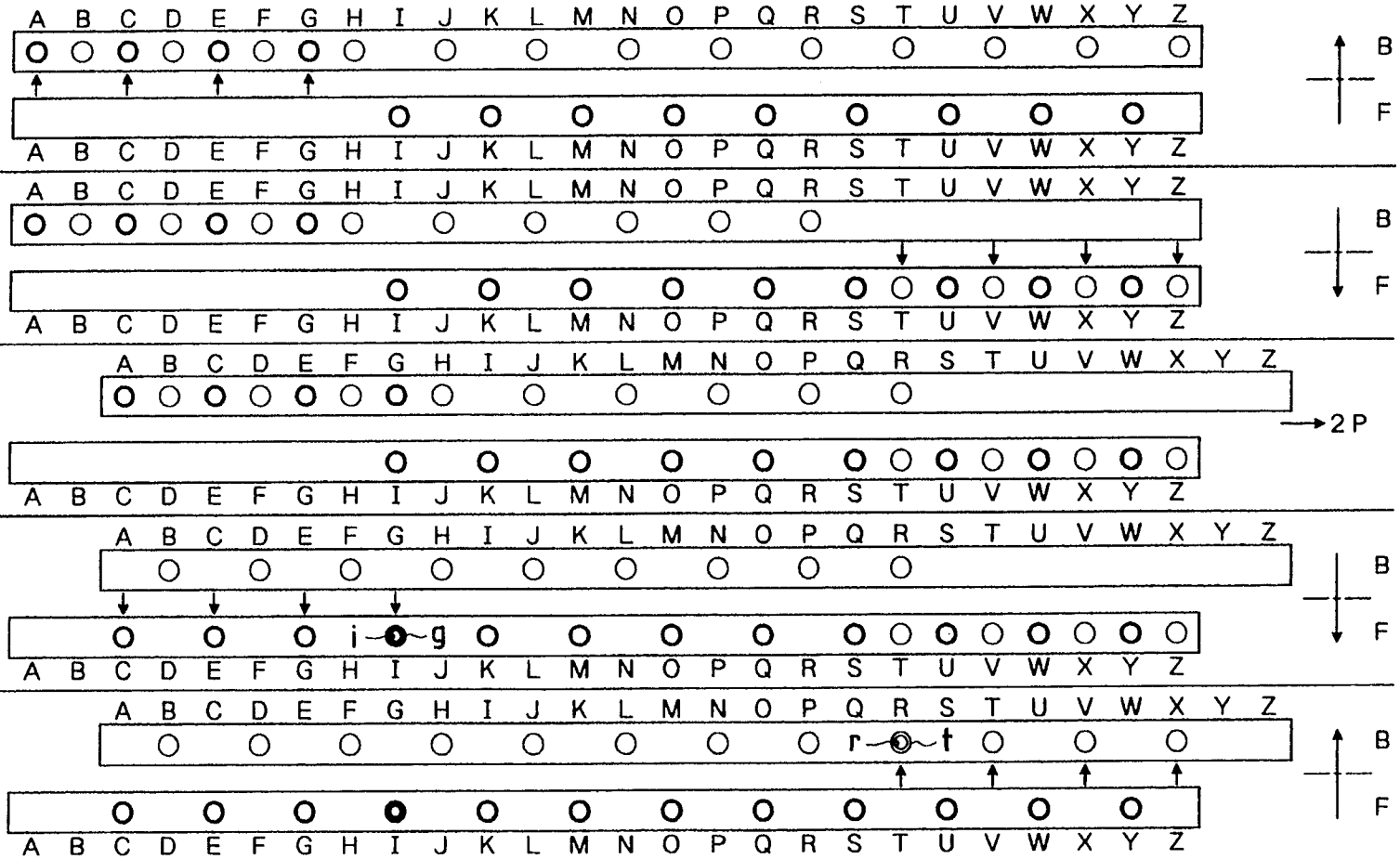
Figures 5, 6, 7, 8, 9, 10, 11, 12, 13:
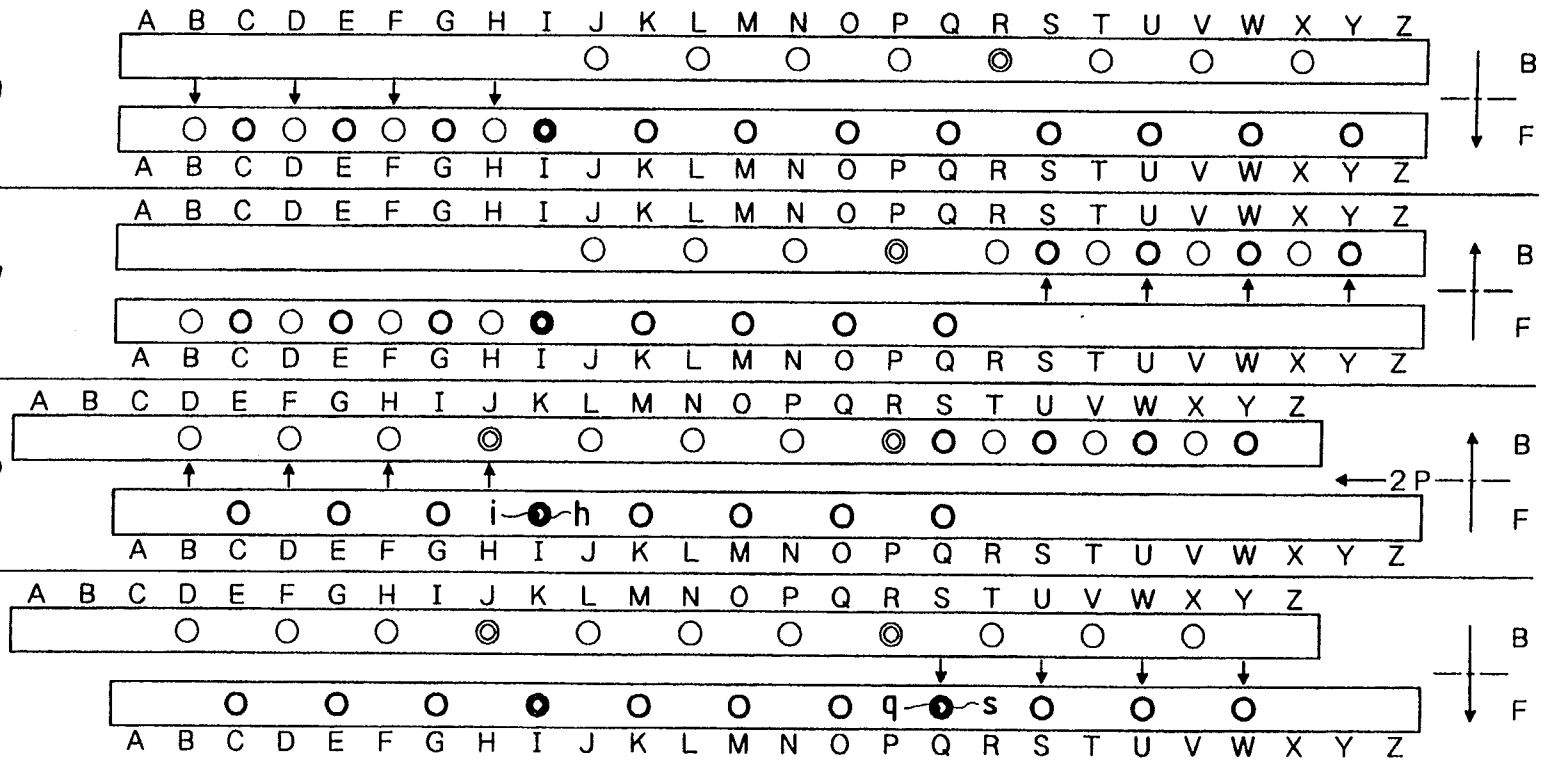
Figures 5, 6, 7, 8, 9, 10, 11, 12, 13, 14, 15, 16, 17:
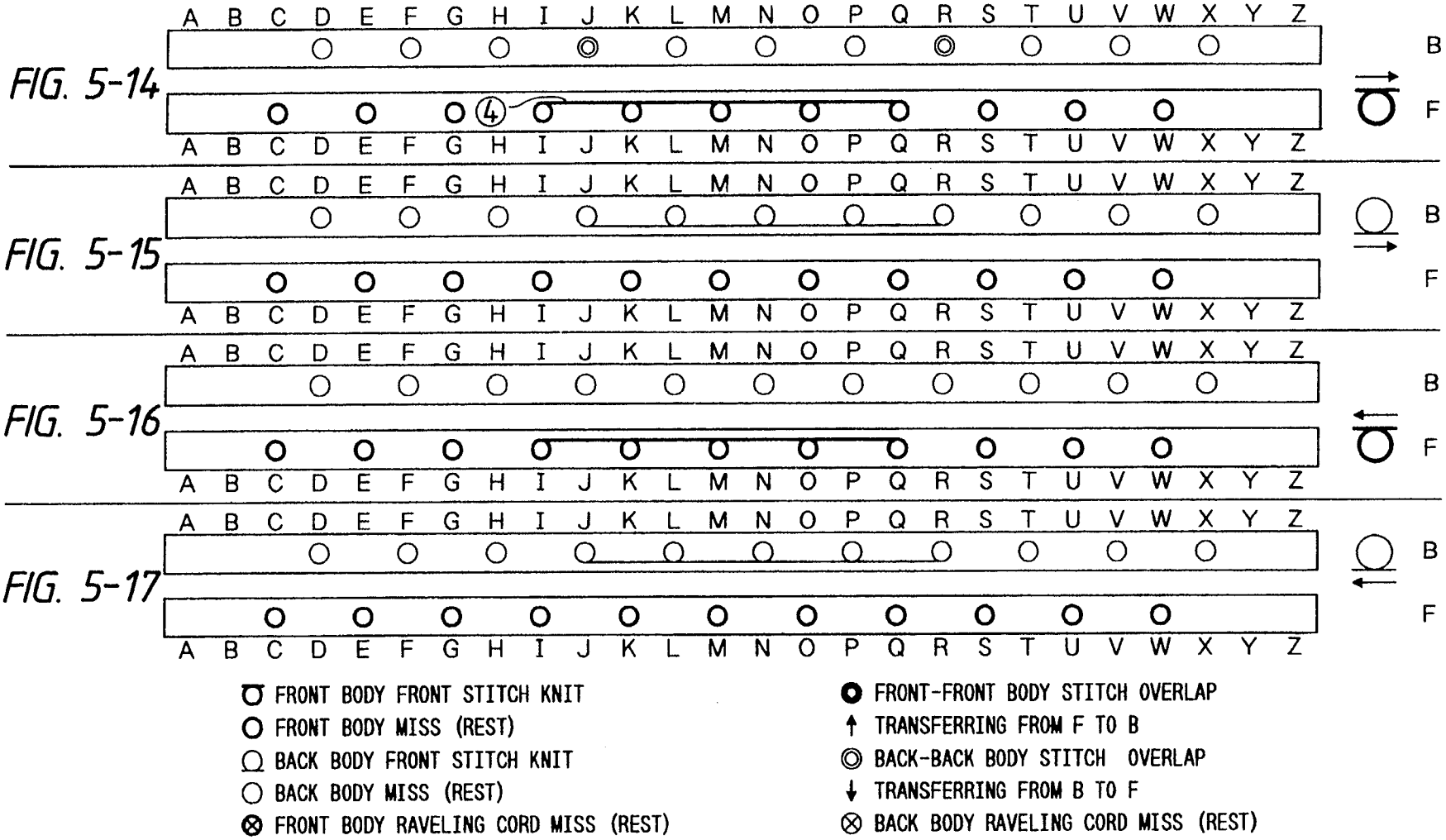

Next, both end loops of the course in the gore 4 and the loops of the bottom rib stitch portion are overlapped and the knitting of the gore 4 is continued. More specifically, the loops engaged with needles A, C, . . ., G on the front bed F side, which have been put at the rest position after cylindrical knitting, are transferred to needles A, C, . . ., G on the back bed B side (FIG. 5—5). Additionally, the loops engaged with needles T, V, . . ., Z on the back bed B side, which have been put at the rest position after cylindrical knitting, are transferred to needles T, V, . . ., Z on the front bed F side (FIG. 5–6). Next, the back bed B is racked rightwards by a distance corresponding to two needles such that needles A, B, . . ., X on the back bed B and needles C, D, . . ., Z on the front bed F are opposite each other (FIG. 5–7). Then, the loops of the left bottom band in the fabric, which have been transferred to needles A, C, . . ., G on the back bed B and put at the rest position, are transferred back to needles C, E, . . ., I on the front bed F. As a result, the loops in the front fabric which have been engaged with needles A, C, . . ., G on the front bed F and put at the rest position move to adjacent needles C, E, . . ., I. Thus, the loop g which has been engaged with the needle G becomes overlapped with the loop i engaged with the needle I in the crotch portion (FIG. 5–8). Similarly, the loops of the right bottom band, which have been transferred to needles T, V, . . ., Z on the front bed F side and put at the rest position in the back fabric 3, are transferred back to needles R. T, . . ., X on the back bed B side. As a result, the loops which have been put at the rest position in the back fabric and engaged with needles T, V, . . ., Z on the back bed B side move to adjacent needles. Thus, the loop t which has been engaged with the needle T becomes overlapped with the loop r engaged with the needle R in the crotch portion (FIG. 5–9).

Thereafter, the racking is returned so that the needles A to Z on the front bed F and the back bed B are opposed to each other. Next, the loops of the left bottom band, which have been put at the rest position in the back fabric and are engaged with needles, B, D, . . ., H on the back bed B side, are transferred to needles B, D, . . ., H on the front bed F side (FIG. 5–10). Further, the loops of the right bottom band, which have been put at the rest position in the front fabric and are engaged with needles S, U, . . ., Y on the front bed F side, are transferred to needles S, U, . . ., Y on the back bed B side (FIG. 5–11) . The back bed B is then racked leftwards by a distance corresponding to two needles such that needles A, B, . . ., X on the front bed F and needles C, D, . . ., Z on the back bed B are arranged opposite one another. Then, the loops of the left bottom band, which have been transferred to needles B, D, . . ., H on the front bed F and put at the rest position in the back fabric, are transferred back to needles D, F, . . ., J on the back bed B. As a result, the loops which have been put at the rest position in the back fabric and engaged with needles B, D, . . ., H on the back bed B side move no adjacent needles D, F, . . ., J and the loop which has been engaged with the needle H becomes overlapped with the loop j engaged with the needle J (FIG. 5–12). Similarly, the loops of the right bottom band, which have been transferred to needles S, U, . . ., Y on the back bed B side and put at a rest position in the front fabric are transferred back to needles W, S, . . ., W on the front bed F side. As a result, the loops which have been allowed to rest in the front fabric and engaged with needles S, U, . . ., Y on the front bed F side move to adjacent needles Q, S, . . ., W, and the loop engaged with the needle S becomes overlapped with the loop engaged with the needle Q in the crotch portion (FIG. 5–13). Subsequent courses "4", "5", "6" are knitted in the same manner as courses "2", "3" (FIGS. 5–14 to 5–16). Once the knitting shown in FIG. 5–16 has been completed, the knitting operation will repeat the operation illustrated in FIG. 5–4 at every cycle point where the loops at the rest position are connected to the crotch portion (a related knitting diagram is omitted).

According to the above described embodiment of the present invention, stitches are moved and joined at every two knitting courses. This is possible because the loop pitch in the wale direction and that in the course direction are well balanced. If the respective weaves are changed and balance is lost, this condition can be remedied by changing the number of courses.

The above described gore knitting operation has been conducted without changing the knitting width of the gore portion. However, when the section knitting of the gore has been completed and a shift is made to the section knitting in the front and back fabrics, the spacing between the bottom bands must be increased gradually during the period after the shift until the cylindrical fabric for covering the belly is reached. In this case, the bottom band portions which are not joined to the gore portion are retained by needles. The knitting width of the gore is increased and the loops at both course ends and the bottom band loops are overlapped and knitted together such that the cylindrical fabric for covering the belly and the bottom rib stitch portions become integral with each other. Thus, in the knitting of the gore portion, the loops of the bottom bands which have been put in the rest position are overlapped with end loops in the gore portion by racking, and, in the knitting of the belly portion, by increasing the number of stitches of the fabric located between the bottom bands, the end loops of the course of that fabric and the loops of the bottom bands which have been put in the rest position.

In one knitting method ill accordance with the present invention, a first fabric is formed by knitting with needles arranged in a predetermined section of a needle bed which is subsequently rendered inoperative. Also, at every knitting of one course of a second fabric formed by knitting with needles arranged in another section of the needle bed, the endmost loops of the course closest to the first fabric and endmost loops of the first fabric itself are overlapped by successive racking at every knitting of a predetermined number of courses in the second fabric. Then, the next course knitting loops are passed through the overlapped loops to join the first and second fabrics together.

Thus, fabrics having different wale directions call be knitted continuously in the knitting process. For example, when manufacturing a knitted article of clothing, it is possible to effect end processing for an arm hole, pull-on openings and other openings, as well as the knitting of the gore in a crotch, such that a sewing step is not required after knitting. Accordingly, manufacturing costs may be reduced. Additionally, in each fabric connection, the respective loops may cross each other in perpendicular course directions. Thus, it is possible to obtain all excellently joined fabric which has so far not been obtainable. Further, where the method of present invention is utilized for end processing, a stronger and more elastic fabric can be obtained by using a thicker yarn than the yarn used in the base stitch portion. Still further, a more fashionable fabric including portions of various colors may be produced by feeding yarns different in color from the base stitch portion.

Although the present invention has been described in terms of a preferred embodiment above, many modifications and/or additions to the above-described preferred embodiment would be readily apparent to one skilled in the art. It is intended that the scope of the present invention extends to all such modifications and/or additions and that the scope of the present invention is limited solely by the claims set forth below.

What is claimed is:

1. A method of making a joined fabric for use with a flat knitting machine having at least a front needle bed and a back needle bed, at least one of the needle beds being laterally movable, the method comprising steps of:

supplying a first yarn to a first portion of the needles of the front needle bed to knit a first cylindrical knitted fabric;

supplying a second yarn to a first portion of the needles of the back needle bed to knit a second cylindrical knitted fabric; and knitting a third fabric for joining the first and second cylindrical knitted fabrics by supplying an unused portion of the first yarn to a second portion of the needles of the front needle bed, the second portion of the needles of the front needle bed being substantially between the first portion of the needles of the front needle bed and the first portion of the needles of the back needle bed, transferring at least one loop of the first cylindrical fabric, which are arranged on the second portion of the needles of the front needle bed, to empty needles of an opposing needle bed, racking the opposing needle bed such that a first end loop of the at least one loop of the first cylindrical fabric is adjacent a second end loop of the third fabric, transferring the at least one loop of the first cylindrical fabric to the opposing needles such that the first end loop of the first cylindrical fabric overlaps the second end loop of the third fabric, and passing a loop of a next course of the third fabric through the overlapped end loops.

2. The method of claim 1, further comprising the steps of:

supplying an unused portion of the second yarn to a second portion of the needles of the back needle bed, the second portion of the needles of the back needle bed being substantially between the first portion of the needles of the back needle bed and the first portion of the needles of the front needle bed; and knitting the third fabric for joining the first and second cylindrical knitted fabrics by supplying an unused portion of the second yarn to a second portion of the needles of the back needle bed, the second portion of the needles of the back needle bed being substantially between the first portion of the needles of the back needle bed and the first portion of the needles of the front needle bed, transferring at least one loop of the second cylindrical fabric, which are arranged on the second portion of the needles of the back needle bed, to empty needles of an opposing needle bed, racking the opposing needle bed such that a first end loop of the at least one loop of the second cylindrical fabric is adjacent a second end loop of the third fabric, transferring the at least one loop of the second cylindrical fabric to the opposing needles such that the first end loop of the second cylindrical fabric overlaps the second end loop of the third fabric, and passing a loop of a next course of the third fabric through the overlapped end loops.

3. A method of processing end portions of knitted fabrics by connecting a first cylindrical fabric and a second cylindrical fabric to a third cylindrical fabric, the first and second cylindrical fabrics being knitted at least a first region of a flat knitting machine having at least a pair of needle beds movable in a lateral direction, the third cylindrical fabric being knitted at a second region of the needle bed in a different direction with respect to a wale direction, the method comprising the steps of:

knitting the first and second cylindrical fabrics respectively using at least the first region of the needle beds;

knitting the third cylindrical fabric by one course using different yarns on each of a front bed and back bed, the first cylindrical fabric having a loop on the front needle bed, the second cylindrical fabric having a loop on the back needle bed, the loops on the needle beds defining an original position;

transferring the loop of the first cylindrical fabric on the front needle bed to an empty needle on the back needle bed, and transferring the loop of the second cylindrical fabric on the back needle bed to an empty needle on the front needle bed;

racking the needle beds so that a loop of the first cylindrical fabric adjacent to the third cylindrical fabric and a loop of the second cylindrical fabric adjacent to the third cylindrical fabric respectively confront one of the loops of the end portions of the third cylindrical fabric;

returning the loop of the first cylindrical fabric transferred to the back needle bed and the loop of the second cylindrical fabric transferred to the front needle bed to the original position;

transferring a loop of the first cylindrical fabric on the back needle bed to an empty needle on the front needle bed and transferring a loop of the second cylindrical fabric on the front needle bed to an empty needle on the back needle bed;

racking the needle beds so that a loop of the first cylindrical fabric adjacent to the third cylindrical fabric and a loop of the second cylindrical fabric adjacent to the third cylindrical fabric respectively confront one of the loops of the end portions of the third cylindrical fabric;

returning the loop of the first cylindrical fabric transferred to the front needle bed and the loop of the second cylindrical fabric transferred to the back needle bed to the original position; and knitting the second course of the third fabric, the step of knitting the second course of the third fabric including the step of knitting a loop which is overlapped with the loop of the first cylindrical fabric and knitting a loop which is overlapped with the loop of the second cylindrical fabric.

4. The method of claim 3, comprising the steps of selecting a first and second yarn having a first color and selecting a third yarn having a second color, the second color being different than the first color.

5. The method of claim 3, further comprising the steps of selecting a first and second yarn having a first thickness and selecting a third yarn having a second thickness, the second thickness being different than the first thickness.

6. The method of claim 3, comprising the steps of:

selecting a first yarn for knitting the first cylindrical fabric and the third cylindrical fabric on one of the needle beds, and selecting a second yarn for knitting the second cylindrical fabric and the third cylindrical fabric on another one of the needle beds.

7. A method of joining a first fabric and a second fabric, the first fabric including yarn knitted by needles arranged in a first section of a needle bed and forming a final course, the second fabric including yarn knitted by needles arranged in a second section of the needle bed and forming a final course, the method comprising the steps of:

knitting a first portion of a third fabric in a first direction with an unused portion of the yarn used to knit the first fabric by using needles arranged substantially adjacent to the needles used for knitting the first fabric, the first portion of the third fabric including first end loops, overlapping the first course of the third fabric and the final course of the first fabric, passing a loop of a course of the third fabric through the overlapped courses of the first and third fabrics, knitting a second portion of the third fabric in a second direction, the second direction opposite the first direction, with an unused portion of the yarn used to knit the second fabric and needles arranged substantially adjacent to the needles used for knitting the second fabric, the second portion of the third fabric including second end loops, overlapping the second end loops of the third fabric and the end loops of the second fabric, passing a loop of a course of the third fabric through the overlapped end loops of the second and third fabrics, and joining the first and second portions of the third fabric to form a single knitted fabric including the first, second and third fabrics.

* * * * *